US006082119A

United States Patent [19]

Ellison et al.

[11] Patent Number: 6,082,119

[45] Date of Patent: Jul. 4, 2000

[54] COMMANDABLY ACTUATED CRYOSTAT

[75] Inventors: Woodrow R. Ellison, Glendale; Kerry R. Kohuth, Waddell; Michael E. Craghead, Tempe, all of Ariz.

[73] Assignee: General Pneumatics Corp., Orange, N.J.

[21] Appl. No.: 09/251,324

[22] Filed: Feb. 16, 1999

[51] Int. Cl.[7] ..... F25B 19/02

[52] U.S. Cl. ..... 62/51.2

[58] Field of Search ..... 62/51.2; 137/238

[56] References Cited

U.S. PATENT DOCUMENTS

| | | | |
|---|---|---|---|
| Re. 34,748 | 10/1994 | Brown | 62/51.2 |
| 3,942,010 | 3/1976 | Peterson et al. | 250/352 |
| 4,028,907 | 6/1977 | Herrington et al. | 62/222 |
| 4,631,928 | 12/1986 | Walker | 62/514 JT |
| 4,738,122 | 4/1988 | Walker | 62/514 JT |
| 5,060,481 | 10/1991 | Bartlett et al. | 62/51.2 |
| 5,181,386 | 1/1993 | Brown | 62/51.2 |
| 5,452,582 | 9/1995 | Longsworth | 62/51.2 |
| 5,595,065 | 1/1997 | Boiarski et al. | 62/222 |

FOREIGN PATENT DOCUMENTS

| | | |
|---|---|---|
| 000582817 | 2/1994 | European Pat. Off. . |
| 2014502 | 10/1970 | Germany . |
| 0290939 | 6/1991 | Germany . |
| 4-04278146 | 10/1992 | Japan . |
| 406213522 | 8/1994 | Japan . |
| 1238470 | 7/1971 | United Kingdom . |

*Primary Examiner*—William Doerrler
*Attorney, Agent, or Firm*—Warren F. B. Lindsley; Frank J. McGue

[57] ABSTRACT

The subject invention relates to a Joule-Thomson cryostat or refrigeration system in which an expansion valve can be commandably actuated to partially withdraw the core of the expansion valve in order to dislodge and flush contaminants that have collected in the valve passageway, to open the expansion valve to increase flow to accelerate cooldown, and to control flow to regulate the amount of refrigeration produced.

7 Claims, 2 Drawing Sheets

COMMANDABLY ACTUATED CRYOSTAT

BACKGROUND OF THE INVENTION

This invention pertains generally to refrigeration systems and more particularly to an improved refrigerant expansion device having means for commandably controlling an expansion valve of the system and clearing from it contaminants such as ice that accumulate in it. The invention is especially useful in cryogenic refrigeration systems employing Joule-Thomson (J-T) expansion devices.

Gases may be cooled below their liquefaction temperatures by expanding from a high pressure to a low pressure in a constant enthalpy process. When the temperature of the gas just prior to expansion is sufficiently below the inversion temperature of the gas (the temperature below which expansion results in a decrease in temperature), part of the gas undergoes a phase change upon expansion, forming a mixture of saturated liquid and saturated vapor. The expansion of gases in this manner is generally effected by so-called J-T cryostat.

A fundamental problem with J-T cryostats is clogging due to ice accumulation in the nozzle. Trace moisture in the operating gas and gas supply system is unavoidable. Depending on gas purity, J-T cryostats usually operate with the nozzle well below the front point of the gas, the temperature at which water or other contaminants freeze out of the gas. For example, at 0.1 MPa (1 atmosphere) pressure, the front point of 2 ppm water is 200K whereas the nozzle operating temperature of a cryostat operating on nitrogen is about 80K or on argon is about 90K. At higher pressures, such as inside the nozzle, the frost point is higher (e.g. 243K for 2 ppm at 20 MPa) and more water will freeze out. Clogging can occur if ice particles accumulate in the nozzle faster than they flush through. The higher the frost point or flow rate, the faster ice can accumulate. Conventional J-T cryostats typically can only operate a few minutes with 2 ppm water. This has typically limited J-T cryostats to applications requiring only short operating durations.

The present invention is directed toward the removal of this limitation so that a broader range of applications may be accommodated. For this purpose, the invention incorporates an actuator, such as a solenoid, at the warm end of the cryostat which can periodically actuate a nozzle control rod to open the nozzle, thereby mechanically dislodging any accumulated ice and causing a gas flow surge which flushes ice out of the nozzle. A return spring returns the nozzle control rod to its normal operating position when the solenoid is deactivated.

The actuator may be activated by a simple electrical power supply on command or through a timer relay to control the activation interval and hold time. In addition to clearing ice from the nozzle, the actuator may hold the nozzle open by prolonged activation or by a passive latching means to accelerate the cryostat cool down rate, or the actuator may be modulated to regulate the amount of refrigeration produced by the cryostat. Such actuated J-T cryostats may be used in a wider variety of applications than conventional J-T cryostats, particularly application requiring prolonged continuous operation and/or commandable active control of the cryostat.

Actuation is particularly well suited to General Pneumatics' patented J-T cryostat design (U.S. Pat. No. 4,631,928), which has a nozzle control rod extending the length of the cryostat.

DESCRIPTION OF THE PRIOR ART

The following patents disclose actuators, regulators, and anti-clogging means used with J-T cryostats:

U.S. Pat. No. 3,924,010 discloses a solenoid valve connected in series with (upstream of) a J-T cryostat. The solenoid valve is opened and closed in response to a temperature sensor as a means for controlling coolant flow. The solenoid does not control the J-T cryostat nozzle.

U.S. Pat. No. 4,028,907 discloses a J-T cryostat controlled by a bimetal cantilever which operates a needle valve at the outlet of the expansion valve in response to expansion chamber temperature.

U.S. Pat. No. 5,060,481 discloses a cryogenic refrigeration system incorporating heaters for melting away frozen contaminants from a J-T expansion valve.

U.S. Pat. No. 5,181,386 and Re. Pat. No. 34,748 disclose a cryogenic cooling apparatus utilizing a J-T expansion valve regulated by a bellows controlled needle valve.

U.S. Pat. No. 5,452,582 discloses a surgical cryo-probe incorporating a J-T expansion valve for cooling with means for terminating cooling and delivering warm gas to the probe tip when surgery is complete.

General Pneumatics' U.S. Pat. Nos. 4,631,928 and 4,738,122 (upon which is based a preferred embodiment of the subject patent) together disclose a J-T cryostat which employs differential thermal contraction to regulate the flow, and a converging annular expansion nozzle incorporating grooved or recessed surfaces to deter blockage of the expansion valve by contaminants.

Patent No. DL290939 discloses a flow regulator for a J-T expansion valve. A needle valve integral with the J-T valve is connected directly or via a lever system with a permanent magnet biased by a spring or its own weight against a super-conductive material exhibiting the Meissner effect.

Patent No. DT2014502 discloses a J-T expansion valve regulated by a bellows for control of refrigerant flow. The bellows is responsive to temperature-sensitive vapor pressure.

Patent No. EP000582817 discloses a J-T expansion valve controlled by a bellows together with an electronic control circuit responsive to an independent temperature sensor for improved response and stability.

Patent No. GB1,238,470 discloses a J-T cooling apparatus in which the expansion valve is controlled by a modulating means utilizing a bellows and including a thermoelectric transducer which produces a signal representing expansion nozzle temperature. Also included is a means for adding to the signal a reference level which regulates the flow of refrigerant.

Patent No. JP406213522 discloses a J-T expansion valve controlled by a driving member having a high degree of heat shrinkage with temperature, the driving member being coupled to an integral needle valve via a pivoting means, causing the valve opening to increase as the temperature rises.

Patent No. JP404278146 discloses a miniature freezer device incorporating a J-T expansion valve wherein the cryogenic state is controlled through the control of pressure at the expansion valve outlet.

Patent No. JP405306845 discloses a J-T cryogenic cooler controlled by a temperature sensor together with an amplifier and a spring-biased electromagnetic valve means upstream of the J-T cryostat. The electromagnetic valve does not control the J-T nozzle.

None of the foregoing patents employ a commandable actuator to control a J-T expansion nozzle or to clear contaminants from it. Control of the flow upstream of a J-T cryostat, such as patent numbers U.S. Pat. No. 3,942,010 and JP405306845, is not thermodynamically efficient and cannot clear contaminants from the J-T nozzle. U.S. Pat. No. 5,060,481 is directed toward removal of frozen contaminants from the J-T nozzle, but the method described involves the use of heaters for melting the contaminants. The expansion valve of U.S. Pat. Nos. 4,631,928 and 4,738,122 is designed to deter clogging due to contaminants, but does not provide a means for dislodging ice once it has formed.

None of the referenced patents employ an actuator which can commandably open the J-T valve to control the flow and/or to clean contaminants from the valve.

SUMMARY OF THE INVENTION

This invention relates to a J-T cryostat in which the expansion valve is commandably actuated for the purpose of controlling the flow and/or clearing contaminants which could otherwise clog the valve and prevent continuous operation over extended periods of time.

It is, therefore, one subject of this invention to provide a new and improved J-T cryostat in which is incorporated a commandable means for clearing contaminants from the expansion valve.

Another object of this invention is to provide a new and improved J-T cryostat in which contaminants are cleared from the expansion valve by abruptly forcibly opening the valve at appropriate intervals.

A further object of this invention is to effect such opening of the J-T expansion valve through the use of a commandable actuator for driving a movable element of the valve.

A still further object of this invention is to provide such an improved J-T cryostat in a form which employs a commandable actuator to provide the expansion valve control functions of flow regulation and contaminant removal.

Further objects and advantages of the invention will become apparent as the following description proceeds and the features of novelty which characterize the invention will be pointed out with particularity in the claims annexed to and forming a part of this specification.

BRIEF DESCRIPTION OF THE DRAWINGS

A preferred embodiment of the present invention may be described by reference to the accompanying drawings in which:

FIG. 5 is the solenoid coil module.

DESCRIPTION OF THE PREFERRED EMBODIMENT

Figure 1:
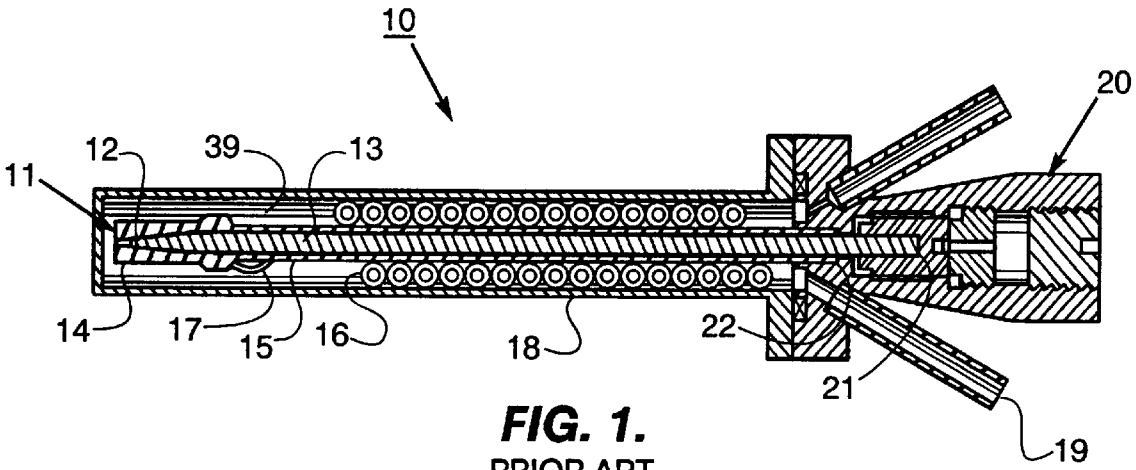
FIG. 1. PRIOR ART
FIG. 1 is a cross-sectional side view of the prior art J-T cryostat disclosed in U.S. Pat. No. 4,631,928. The present invention represents an improvement over this prior art device.

Referring more particularly to the drawings by characters of reference, FIG. 1 illustrates the prior art cryostat 10 which has been found readily adaptable for the incorporation of a solenoid actuator. The cryostat 10 incorporates a J-T expansion valve 11 as described in U.S. Pat. No. 4,738,122 incorporated herein by reference.

In the illustrative embodiment, expansion valve 11 includes a control valve member or valve core 12 supported at an end of an elongate core shaft or control rod 13. Expansion valve 11 further includes a tapered nozzle 14 supported by a tubular sheath 15 slidably received over and coaxial with the core shaft 13. Sheath 15 surrounds core shaft 13 along the major portion of the core shaft length, as shown. Sheath 15 also constitutes a mandrel about which finned tubing 16 is wrapped to serve as a heat exchanger in a conventional manner. One end 17 of tubing 16 is connected into the tapered expansion valve nozzle 14.

With continued reference to FIG. 1, it will be seen that the finned tubing heat exchanger and expansion valve portions of cryostat 10 closely fit within an outer sheath 18 in the form of a cylinder which is closed at one end. The closed end of outer sheath 18 defines an expansion chamber 39 for vapor exiting valve 11. The cold expanded gas flows back along the wrapped finned tubing heat exchanger 16, between mandrel sheath 15 and outer sheath 18, and absorbs heat from the incoming high pressure gas within the tubing, thereby precooling incoming gas prior to expansion. The expanded gas then exits from an outlet 19 at the open end of the outer sheath 18.

It will be appreciated that in practice, outer sheath 18 will ordinarily be incorporated in a dewar vessel into which the cryostat 10 is installed, which is illustrated herein to facilitate understanding of the basic operation of a J-T cryostat. The structural details of the exemplified prior art J-T cryostat 10 with expansion valve 11 are described in U.S. Pat. Nos. 4,631,928 and 4,738,122, respectively.

Valve member 12 and valve seat 14 are arranged with their opposing peripheral surfaces spaced slightly apart to define an annular passageway which converges and terminates at an annular expansion opening at the free extremity of the valve. High pressure gas is fed into the upstream end of the converging annular passageway through an opening in sheath 15 wherein end 17 of tubing 16 is received.

Referring again to FIG. 1, it will be seen that at the end of the cryostat 10 opposite expander valve 11 (i.e., at the "warm" end of the cryostat), the ends of core shaft 13 and mandrel sheath 15 are connected to an assembly 20 which holds the core shaft and sheath in adjustable relative axial positions.

Referring again to FIG. 1, holding means assembly 20 includes provision so that the axial position of core shaft 13 relative to mandrel sheath 15 may be adjusted. More particularly, assembly 20 permits adjustment of the positional relationship between respective ends 21 and 22 of the core and sheath opposite valve 11 in order to vary the clearance between the opposing peripheral surfaces of valve member 12 and valve seat 14. By varying the aforementioned clearance, the effective flow area of converging annular expansion valve passageway may be adjusted.

Additional details regarding the adjustment means, materials and dimensions of the exemplified prior art J-T cryostat will be found in the aforementioned U.S. Pat. Nos. 4,631,928 and 4,738,122 and are included herein by reference.

The prior art cryostat 10 of FIG. 1 is specifically designed to deter blockage by refrigerant contaminants. But while the unique design of the expansion valve 11 with its conical core member 12 and its tapered seat 14 does discourage clogging of the expansion valve by contaminants, the valve 11 is still subject to accumulation of contaminants such as ice bridging the valve members. Under prolonged operation and even with relatively low levels of contaminants such as moisture present in the refrigerant, such accumulation can limit operating time and acceptable moisture levels.

The present invention retains the basic features of the prior art cryostat 10 with its anti-clogging expansion valve 11 and its finned tubing heat exchanger 16. The adjustment assembly 20 is modified to accommodate an actuator which is incorporated as a means for commandably opening the expansion valve 11 and clearing it of accumulated contaminants.

Figure 2:
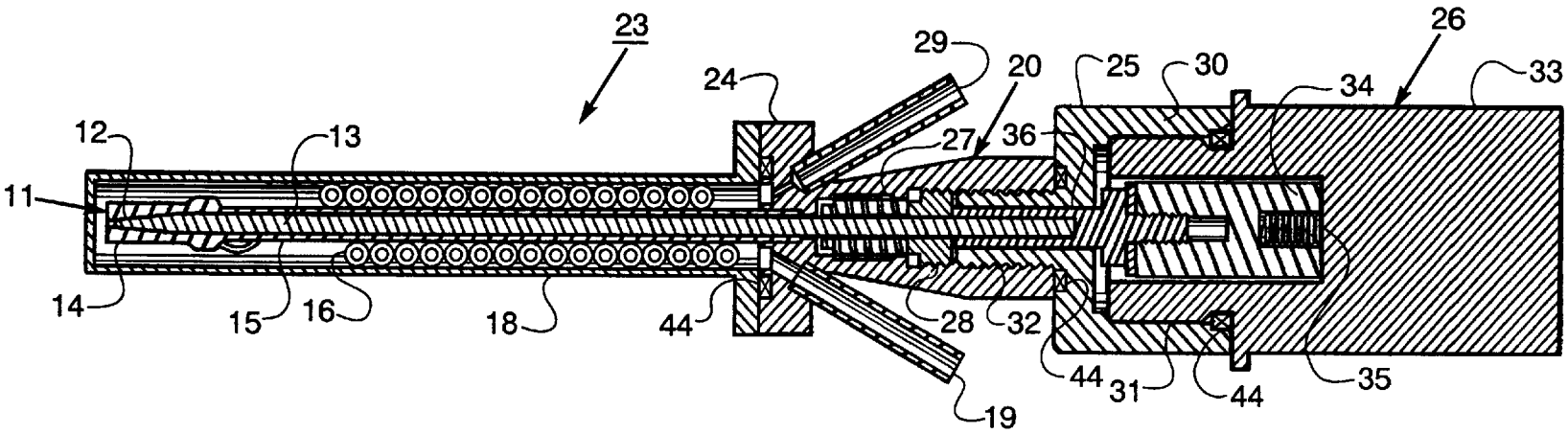
FIG. 2 is a cross-sectional side view of a solenoid actuated J-T cryostat of the present invention; other forms of actuator, such as a moving coil, moving magnet, piezoelectric, stepper motor, geared motor, pneumatic or hydraulic cylinder, etc., might be employed; it is intended to not limit the scope of this invention to any particular type of actuator employed.

As shown in the cross-sectional diagram of FIG. 2, the solenoid actuated cryostat 23 of the present invention comprises a J-T expansion valve 11, a finned tubing heat exchanger 16 wound over a tubular mandrel sheath 15, a cryostat body assembly 20 with integral support flange 24, a solenoid adapter 25, and a solenoid actuator 26. The sheath 15 extends from the cryostat body or assembly 20 to the expansion valve 11 where it supports the tapered valve seat 14. As it typical for J-T cryostats, the cryostat 23 is intended to fit into an outer sheath 18.

The J-T expansion valve 11 is preferably of the same construction as that shown for the prior art valve 11 of FIG. 1, including a conical valve core 12 and a tapered valve member or seat 14.

The cryostat body or assembly 20 is the central means to which the various elements of the cryostat are secured. It houses expansion valve adjustment rings 27 and 28 and refrigerant inlet and outlet ports, 29 and 19, respectively, as discussed in a later part of this specification.

Solenoid adapter 25 serves as a means for securing the solenoid 26 to cryostat body or assembly 20. As shown in FIG. 2, adapter 25 has a cup-shaped main body 30 that threadably receives an end 31 of solenoid actuator 26, and a smaller externally threaded hollow cylindrical stub 32 extending coaxially from the base of main body 30 that is threadably received by cryostat body or assembly 20. The hollow interior (see FIG. 4) of stub 32 extends through the bottom of cup-shaped main body 30.

Solenoid actuator 26 comprises a pressurizable cylindrical coil module 33 and a cylindrical plunger 34. Plunger 34 is operable within a cylindrical opening that extends concentrically into coil module 33 at the same end of coil module that is threadably received by adapter 25.

Plunger 34 has a concentrate cylindrical cavity at each end. The first of these two cavities houses a solenoid return spring 35; the second cavity is coupled to the valve core control rod 13 by means of a control rod adapter 36.

Figure 3:
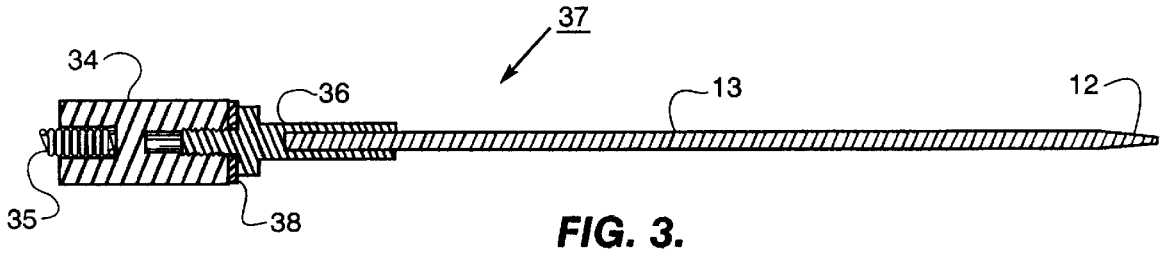
FIGS. 3, 4, and 5 show the cryostat of FIG. 2 partially disassembled in order to more clearly distinguish the valve core or FIG. 3 from the remaining elements of the cryostat as shown in FIGS. 4 and 5.

The valve core subassembly 37, as shown in the cross-sectional side view of FIG. 3, comprises the solenoid plunger 34, the solenoid return spring 35, control rod adapter 36, valve core control rod 13, valve core 12, and a solenoid stroke shim 38 which comprises one or more flat washers of carefully determined thickness.

Adapter 36 comprises an elongate coupler with a plunger connector at one end and a control rod connector at the other. The plunger connector comprises a cylindrical extension that fits inside a cavity of plunger 34. The control and connector comprises a hollow cylindrical extension with an internal diameter that receives the cylindrical body of the expansion valve control rod 13. Intermediate the two connectors is an annular ridge or stop that abuts the end of plunger 34 when connector 36 is fully inserted into the cavity of plunger 34.

Prior to insertion of connector 36, however, the solenoid stroke shim 38 is mounted in place over connector 36. Various means may be employed for securing the two connections. If the shim dimensions have been predetermined for the intended application, a permanent means such as an epoxy cement may be employed for the plunger connection. If the application involves trial and error testing and repeated adjustment of shim dimensions, a threaded connection may be employed.

Figure 4:
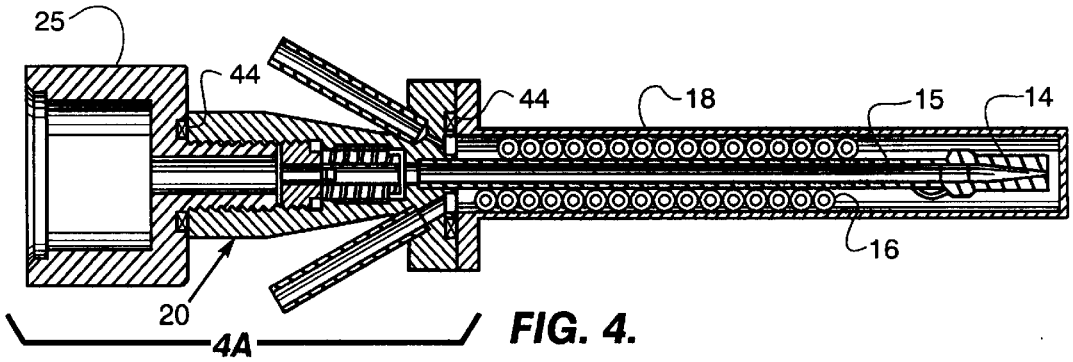

FIG. 4 shows the solenoid actuated cryostat of the invention with the valve core subassembly 37 and the solenoid coil module 33 removed. This subassembly includes the solenoid adapter 25, cryostat body 20, finned tubing heat exchanger 16, mandrel sheath 15, and tapered expansion valve seat 14. Also outlined is the outer sheath 18 into which the cryostat would typically fit.

Figure 4A:
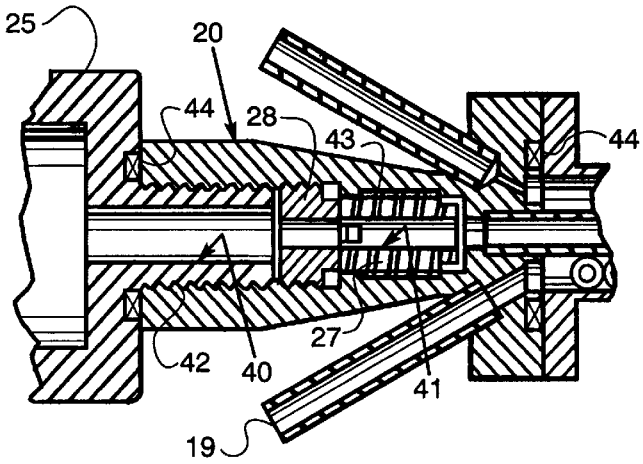
FIG. 4A is an enlarged view of section 4A of FIG. 4.
Figure 5:
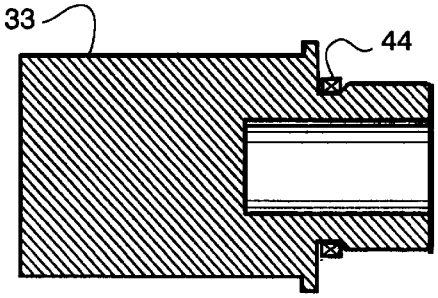

The separate subassemblies of FIGS. 3 and 4 along with the enlarged cross-section of the cryostat body 20 in FIG. 4A are shown in order to facilitate an explanation of the manner in which these subassemblies fit and operate together.

With reference to FIGS. 4 and 4A, attention is called to the interior dimensions of the cavities which receive the valve core subassembly 37. The cylindrical channel into which the core subassembly operates comprises two sections of different diameters.

The first section comprises the hollow interior of solenoid adaptor 25. The second section comprises the remainder of the channel, including the interiors of the two adjustment rings 27 and 28 and the inside surface of tubular mandrel sheath 15 on which the finned tubing 16 is wound. As shown in FIG. 4A, the internal diameters of these first and second sections are referenced 40 and 41, respectively. When subassembly 37 is installed, valve core 12 and control rod 13 must fit into and operate freely within the second section, and the control rod connector of control rod adaptor 36 must operate freely within the first section. The valve core and control rod must therefore have diameters somewhat smaller than diameter 41, and control rod connector 36 must have an overall diameter somewhat smaller than diameter 40 as shown in FIG. 4A. It will also be noted that when valve core subassembly 37 is installed in the subassembly of FIGS. 4 and 4A, a maximum degree of entry occurs when the end of control rod connector 36 impinges upon expansion valve adjustment ring 28.

Critical steps in the installation of the valve core subassembly are the adjustments of the normal operating position and the withdrawn (actuated) position of the valve core. The normal operating position is set by means of adjustment rings 27 and 28 while the withdrawn position is set by means of the solenoid stroke shim 38 shown in FIG. 3.

As shown most clearly in FIG. 4A, the interior of cryostat body 20 has a first threaded interior 42 of a relatively large diameter and a second threaded interior 43 of a lesser diameter. The second threaded interior 43 mates with the threaded exterior of adjustment ring 27 while the first threaded interior 42 mates with the threaded exterior of adjustment ring 28 and solenoid adapter 25. The two adjustment rings and their respective threaded receptacles are oppositely threaded, i.e., if adjustment ring 28 and adapter 25 have right-hand threads, adjustment ring 27 will have left-hand threads. This arrangement is intended to permit locking the two adjustment rings together to secure their set positions.

The appropriate position of the adjustment rings for a particular application and associated cooling rate may be determined by trial and error, with tests conducted at different settings, or tests may be conducted on a prototype at various flow rates and the results tabulated in the form of calibration curves. The set positions can be identified and set in terms of the number of turns or fractions of turns backed off from a fully installed ring setting. Once the appropriate valve adjustment position for ring 27 has been determined and set, ring 28 is tightened against ring 27. It will be noted that ring 28 has its outer edge cut back at its end adjacent to ring 27 to allow a small degree of penetration for ring 28 into threaded interior 41. This is done to extend the available adjustment range and assure contact between the two rings.

After completion of the normal operation calibration as just described, the stroke of the solenoid plunger and thus the actuated withdrawal position of the valve core is set by installing the shim 38 on plunger connector 36. Again, this procedure may comprise a trial and error process or be based upon data compiled from prototype testing.

Because the interior of the cryostat is under pressure, the interfaces between various components need to be sealed to prevent loss or refrigerant. For this reason, O-rings 44 are provided at the indicated locations.

With the cryostat 23 fully assembled, operation of the cryostat proceeds as follows (with reference to FIG. 2):

With the solenoid not energized, return spring 35 forces plunger 34 to an extended position in which the end of the control rod connector 36 seats against adjustment ring 28. This is the normal operating condition in which the cryostat of the invention operates in the same manner as that of the prior art cryostat 10 of FIG. 1. Refrigerant gas at high pressure enters inlet port 29 at the warm upstream end of the cryostat 23, passes through the finned tubing 16 of the heat exchanger and into the expansion valve 11 where the gas expands and cools as it passes through the expansion valve. The expanded cold gas flows around and over the exterior of the finned tubing 16 to the refrigerant exhaust port 19 from which it is collected or discharged, as in the case of the prior art cryostat 10.

In long term operation, contaminants such as ice may form on the expansion valve surface, bridging the gap between its conical core and its tapered seat. To counter such, the solenoid actuator coil may be energized by means of a control circuit to withdraw the valve core to the set position to dislodge and flush contaminants from the valve. The solenoid may then be deactivated to return to normal operation. The actuator may also be energized to override cryostat self-regulation to accelerate cooldown, and may be modulated to regulate the amount of refrigeration produced, such as for closed-loop control.

Material selections for the prior art cryostat of FIG. 1 apply to like parts of the present invention. For adapters 25 and 36, adjustment rings 27 and 28, and for cryostat body 20, a suitable material is stainless steel.

While the present invention has been described as incorporating various features of the prior art cryostat of FIG. 1, including self-regulation wherein the valve tends to open as temperature rises, and the clog resistance provided by the conical expansion valve, it is not to be assumed that these features are of necessity essential to the present invention. Although only a preferred embodiment of the invention has been illustrated and described, it will be apparent to those skilled in the art that various changes and modifications may be made therein, such as employing forms of actuators other than a solenoid, without departing from the spirit of the invention or from the scope of the appended claims.

What is claimed is:

1. A Joule-Thomson refrigeration system wherein a compresses refrigerant fluid is expanded to effect cooling, said system comprising:

a cryostat;

said cryostat comprising an expansion valve located at the cold downstream end of said cryostat;

said expansion valve having a valve core and a cooperating valve seat;

a commandable actuator located at the warm upstream end of said cryostat;

said actuator being coupled to said valve core such that when said actuator is energized said valve core withdraws from said valve seat to a more open position, and when said actuator is deenergized or reversed said valve core returns to its normal operating position; whereby when said valve core is withdrawn to its more open position, any contaminants that have accumulated in said expansion valve are dislodged and flushed from said expansion valve by the increased flow of refrigerant and when said valve core of said expansion valve is returned to its normal operating position, normal expansion of said system resumes;

said actuator providing a means by which said expansion valve can be commandably controlled to clear contaminants from it, increase flow to accelerate cooldown, and modulate flow to regulate the amount of refrigeration produced.

2. The refrigeration system set forth in claim 1 wherein:

said valve core has a conical configuration that converges toward its downstream end.

3. The refrigeration system set forth in claim 2 wherein:

said valve seat tapers in a mating fashion with said valve core such that there is formed between the conical surfaces of said conical core and said tapered valve seat an annular passageway having an upstream end into which refrigerant fluid is introduced under pressure and a downstream end terminating in an annular expansion opening through which the fluid is expanded.

4. The refrigeration system set forth in claim 3 in further combination with:

a heat exchanger comprising a coil of finned tubing wound about a tubular mandrel sheath and positioned upstream of said annular passageway.

5. The refrigeration system set forth in claim 4 in further combination with:

a valve core control rod;

adapter means for adjustably securing an actuator to the warm end of said cryostat; and valve core control rod adapter means for adjustably connecting the warm upstream end of said control rod to said actuator.

6. The refrigeration system set forth in claim 5 wherein:

an adjustable control rod positioning means is incorporated within said cryostat to establish the normal operating position of said valve core control rod relative to said cryostat.

7. The refrigeration system set forth in claim 5 wherein:

the upstream end of said control rod is coupled to said actuator and the downstream end of said control rod is connected to said expansion valve core for the purpose of commandably controlling the degree of opening of said expansion valve.

* * * * *